United States Patent [19]

Ellis

[11] 3,994,119

[45] Nov. 30, 1976

[54] APPARATUS FOR SEALING FOOD PACKAGES

[75] Inventor: James R. Ellis, Cypress, Calif.

[73] Assignee: Le Roy Enterprises, Inc., Los Alamitos, Calif.

[22] Filed: Oct. 20, 1975

[21] Appl. No.: 623,815

[52] U.S. Cl. ..... 53/388

[51] Int. Cl.[2] ..... B65B 51/14

[58] Field of Search ..... 53/387, 388

[56] References Cited

UNITED STATES PATENTS

| | | | |
|---|---|---|---|
| 2,904,941 | 9/1959 | Midnight | 53/387 X |
| 3,145,518 | 8/1964 | Ricca | 53/387 |
| 3,236,027 | 2/1966 | Schmermund | 53/388 |

*Primary Examiner*—Travis S. McGehee

*Attorney, Agent, or Firm*—Fulwider, Patton, Rieber, Lee & Utecht

[57] ABSTRACT

An apparatus for sealing food packages in which a plurality of packages are successively inserted into the bottom of the apparatus, moved upwardly within the apparatus and initially heat sealed. The packages are then held in a vertical stack within the apparatus and subjected to continuous sealing pressure for an extended period of time while they move upwardly to the top of the stack. Automatic means are provided for moving the packages upwardly within the apparatus, performing the initial sealing operation and removing the sealed packages from the top of the stack.

5 Claims, 7 Drawing Figures

FIG. 1
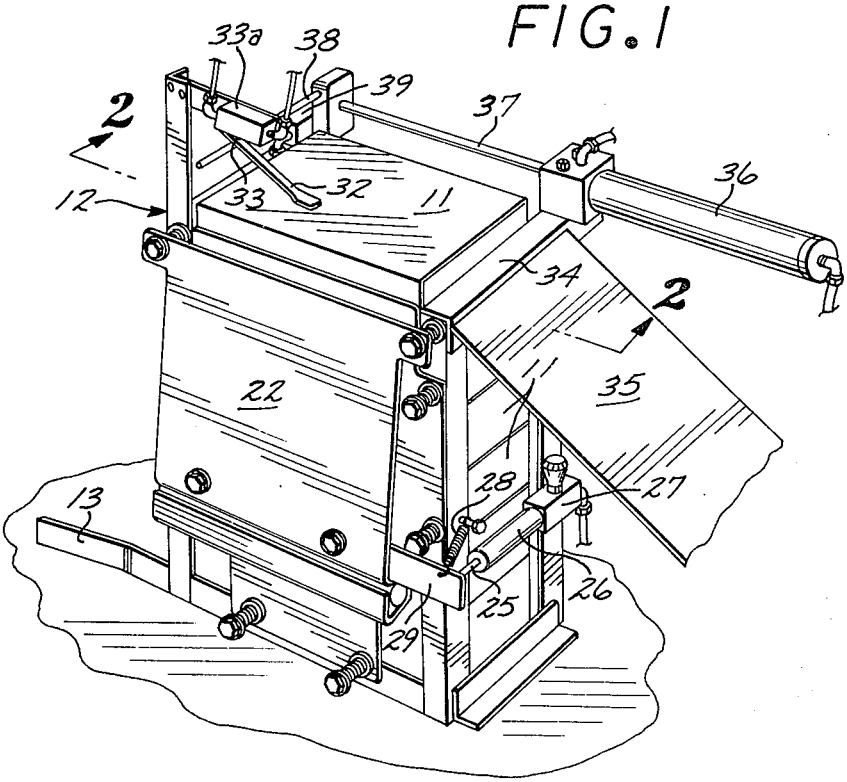
FIG. 3
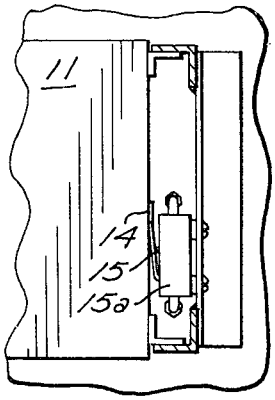
FIG. 4
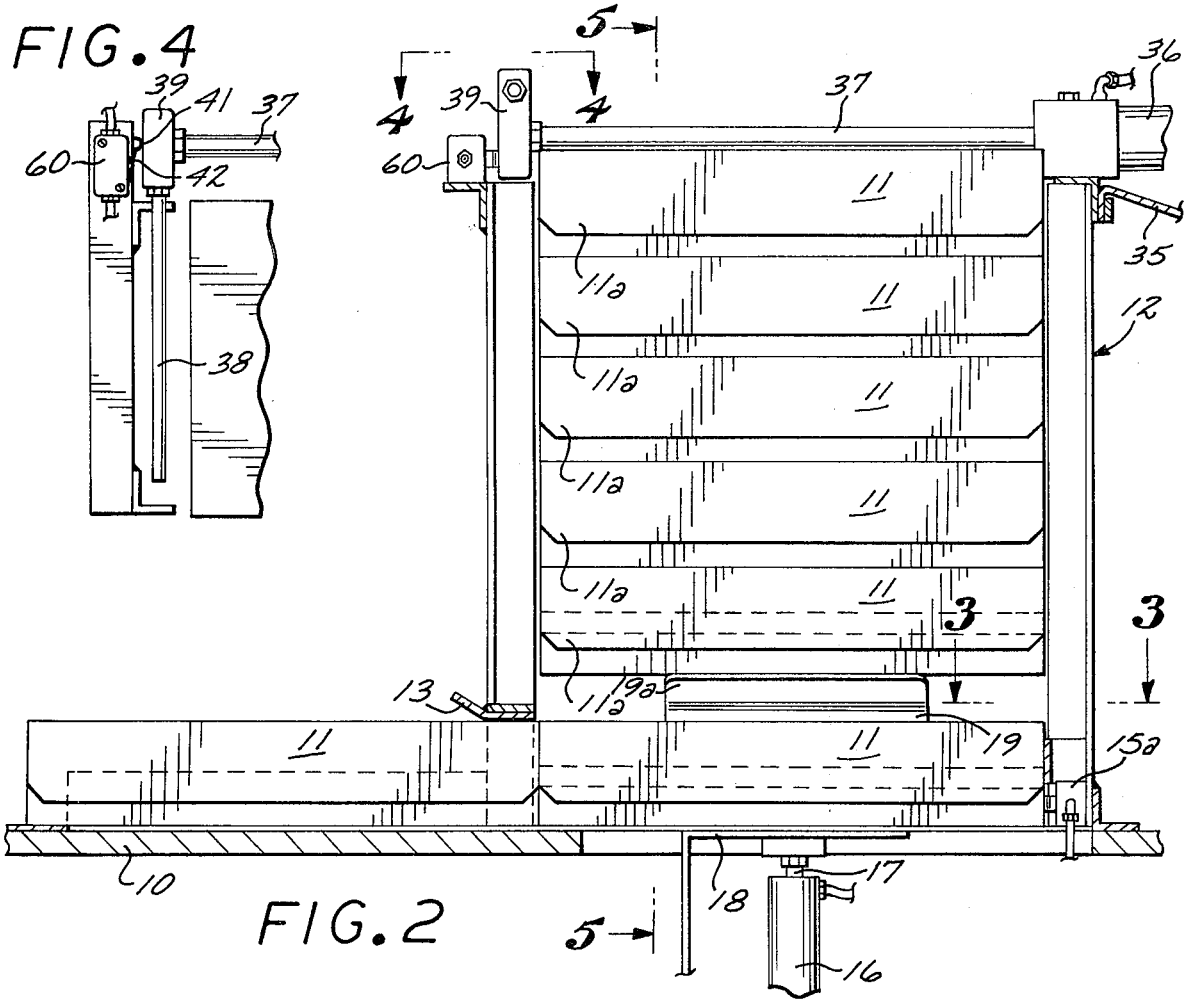
FIG. 2

APPARATUS FOR SEALING FOOD PACKAGES

BACKGROUND OF THE INVENTION

1. Field of the Invention

The invention relates to an apparatus for sealing food packages and particularly those containing ice cream.

2. Description of the Prior Art

Various devices and methods are now in use to seal food packages and particularly packages of ice cream. Such devices and methods are deficient in failing to provide heat and pressure for a sufficient duration of time to assure a perfect seal. In the case of ice cream or other frozen products, it is obvious that heat cannot be applied for an extended period of time. It is accordingly necessary to apply heat for a limited period of time, followed by pressure for an extended period of time in order to assure a seal.

Devices of the type now in use are particularly unable to provide an extended duration of sealing time in a manner which is compatible with an assembly line operation in which sealing is performed on a continuously moving stream of packages.

SUMMARY OF THE INVENTION

The invention provides an apparatus for sealing food packages and particularly those containing ice cream and frozen products in a continuous assembly line operation while at the same time providing the necessary extended period of pressure to achieve a perfect seal.

The invention in particular provides such an apparatus in which there is an initial heating and sealing action of short duration, followed by pressure which is continuously maintained over an extended period of time which is far greater than that of the initial heating and sealing action.

The apparatus provides for sealing pressure which is maintained continuously while a plurality of succeeding packages are undergoing the initial sealing operation. This is preferably achieved by maintaining the initially sealed packages in a vertical stack within the apparatus while they are subjected to continuous sealing pressure while being moved upwardly toward the top of the stack by successive packages moving up from below.

The invention further provides means for automatically performing all of the sealing and stacking operations in proper sequence and duration for a practical and economical assembly line operation.

DESCRIPTION OF THE DRAWINGS

FIG. 1 is a perspective view of the apparatus in use, with the heating applicator plate in open position;

FIG. 2 is a longitudinal sectional view of the same taken on line 2—2 of FIG. 1;

FIG. 3 is a partial sectional view taken on line 3—3 of FIG. 2;

FIG. 4 is a partial top plan view taken on line 4—4 of FIG. 2;

DESCRIPTION OF THE PREFERRED EMBODIMENT

Figure 5:
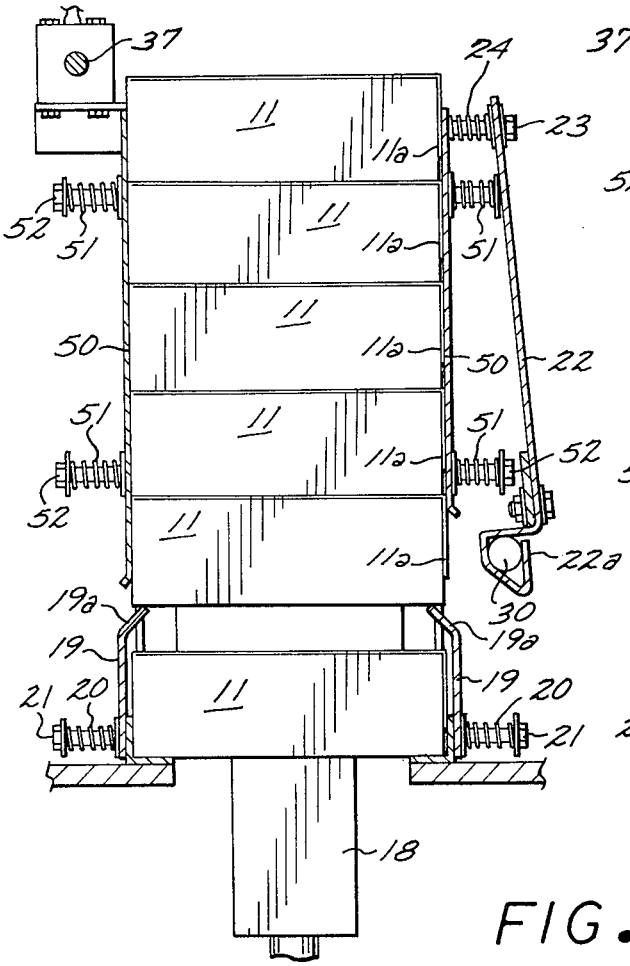
FIG. 5 is a transverse sectional view taken on line 5—5 of FIG. 2.

A preferred embodiment which has been selected to illustrate the invention is adapted to be used with a supply line or track 10, along which a continuous stream of packages such as ice cream packages 11 are moved either manually or automatically. A sealing apparatus 12 has a plurality of guides 13 for facilitating movement of the packages 11 into a receiving area which comprises the lower part of the interior of the apparatus 12.

The apparatus 12 is slightly larger in length and width than the packages being sealed and is preferably dimensioned so that a plurality of packages 11 are disposed in a vertically aligned stack within the apparatus 12 at all times during its operation.

Referring to FIG. 2 of the drawings, the packages 11 are moved along the track 10 and are initially moved into the lower portion of the apparatus 12, as shown by the package 11 at the right side of FIG. 2. As the package 11 moves completely into the apparatus 12, its forward edge engages the arm 14 of a microswitch 15, as shown in FIG. 3 of the drawings. Operation of the microswitch 15 acts to open a valve 15*a*, permitting the spring 40*a* of a spool valve 40 to move the piston 40*b* of said valve 40 to a position in which hydraulic pressure is switched from the upper to the lower portion of a pneumatic cylinder 16 which is disposed beneath the apparatus 12. The upper end of the piston 17 of cylinder 16 is connected to a right angular platform 18 which is disposed directly beneath the lowermost package 11.

Figure 6:
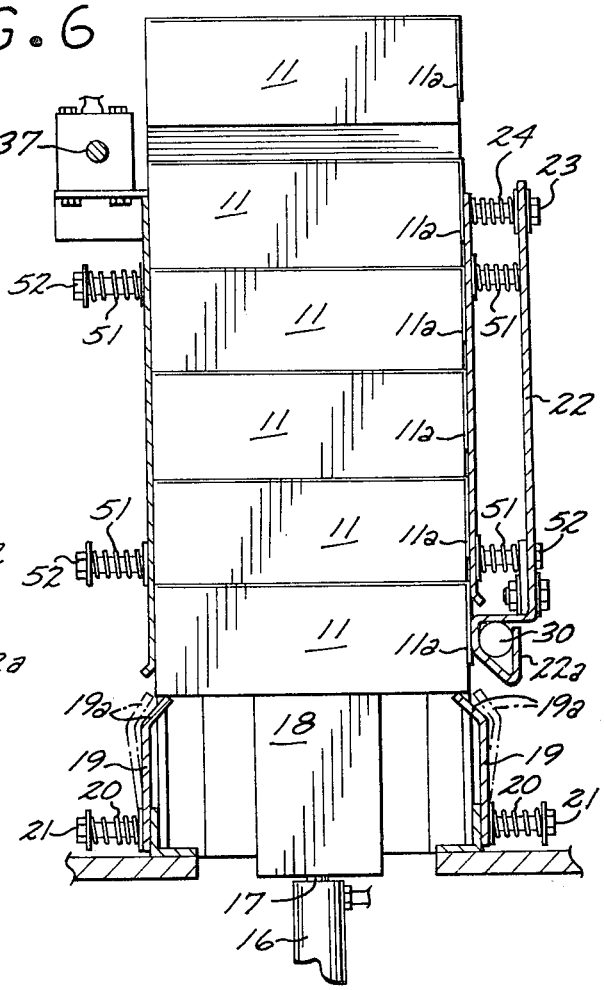
FIG. 6 is a view similar to FIG. 5, with the heat applicator plate in closed position performing the initial sealing operation and the top package being removed from the top of the stack.
Figure 7:
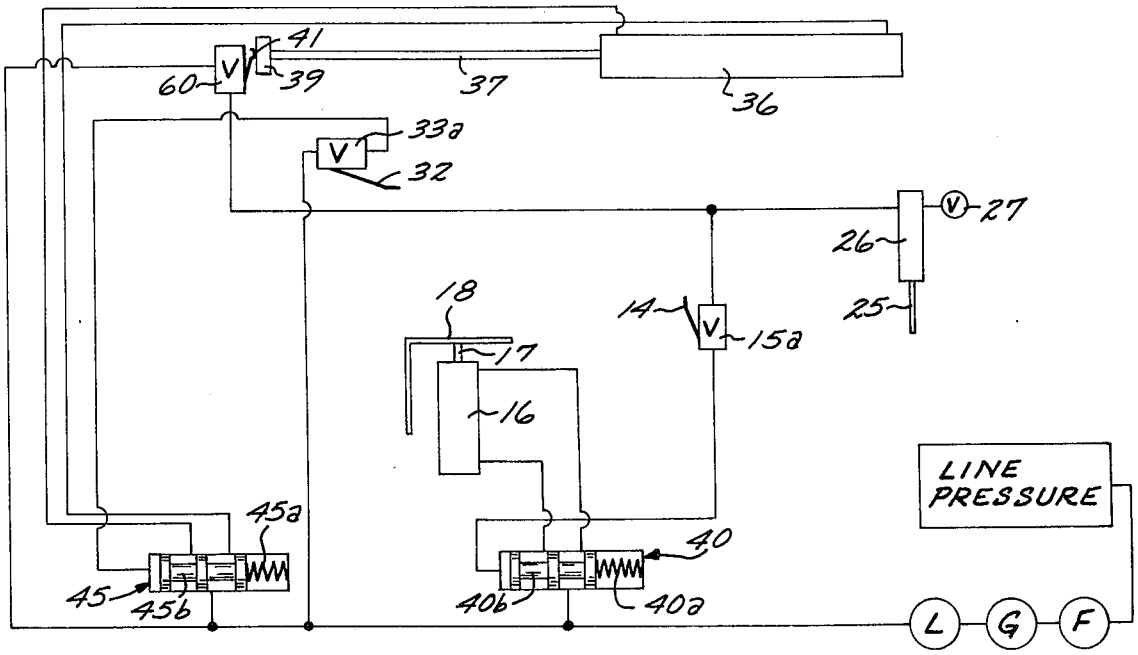
FIG. 7 is a schematic view of the control switches and valves used to operate the apparatus.

Operation of the cylinder 16 results in upward movement of the piston 17 and platform 18, thereby moving the lowermost package 11 upwardly past a pair of package supports 19 which are shown in FIGS. 2, 5 and 6 of the drawings. The package supports 19 have lower straight portions and inwardly bent upper portions 19*a*. The upper ends 19*a* are normally urged inwardly by coil springs 20 mounted on bolts 21.

As the lowermost package 11 is moved vertically upwardly by the platform 18, it engages the upper ends 19*a* and moves them outwardly against the urging of the coil springs 20. After the lower edge of the package 11 has moved past the top of the upper ends 19*a*, the springs 20 automatically move the upper ends 19*a* inwardly into a position in which they support the package 11 which has just moved past them as well as other packages 11 which are stacked above it.

As the lowermost package 11 moves upwardly, it moves past the arm 14, allowing the microswitch 15 to return to its normal position. However, the cylinder 16 does not retract the piston 17 and platform 18 to their normal position until the end of a complete cycle.

As the lowermost package 11 is moved upwardly as described, the packages 11 stacked above it within the apparatus 12 are also moved upwardly. Upward movement of the top package 11 causes upward movement of an elongated arm 32 which extends across the top of the uppermost package 11. Upward movement of the arm 32 causes the operation of an adjacent microswitch 33 when the uppermost package 11 reaches a point where its bottom edge is substantially aligned with an adjacent slide entrance 34. Disposed on the opposite side of the slide entrance 34 is an angularly downwardly directed slide 35.

Operation of the microswitch 33 causes the opening of a valve 33*a*, permitting the spring 45*a* of a second spool valve 45 to move the piston 45*b* of said valve 45 to a position whereby pressure is switched from the back to the front of a pneumatic cylinder 36. The cylinder 36 is thereby caused to retract its piston 37. Attached to the end of the piston 37 is a transversely directed sweep rod 38, which is adapted to engage the adjacent end of the uppermost package 11 and sweep such package from the top of the stack over the slide entrance 34 and onto the slide 35. From such position, the package moves downwardly along the slide 35 by the force of gravity.

A heat applicator plate 22 is mounted on one side of the apparatus 12. The upper end of the plate 22 is pivotally mounted on a pair of bolts 23 which are surrounded by coil springs 24. The lower end of the heat applicator plate 22 is normally held away from the side of the apparatus 12 by the piston 25 of a pneumatic cylinder 26. A bleed or delay valve 27 is connected to the cylinder 26. A coil spring 28 which extends between the corner of the apparatus 12 and a bar 29 projecting from the plate 22 acts to normally pull the lower end of the plate 22 toward the apparatus 12.

As shown in FIG. 6 of the drawings, the lower end of the plate 22 is bent to form a channel 22*a* within which is mounted a heating rod 30 which is connected to a suitable source of electrical supply. The channel 22*a* has a vertically directed edge 31 which is adapted to fit against the side of the package 11 which is engaged by the package supports 19. The package supports 19 support the weight of all of the packages 11 disposed above them and prevent such weight from interfering with the insertion of a new package into the apparatus 12.

The previously described piston 37 of the pneumatic cylinder 36 and the sweep rod 38 are attached to a corner member 39, which normally engages the arm 41 of a microswitch 42, as shown in FIG. 4 of the drawings. As the piston 37 retracts, the corner member 39 is moved away from the arm 41 of the microswitch 42.

When the microswitch 42 is opened, it opens a valve 60 to open the supply of pressure to the pneumatic cylinder 26. The pressure within the cylinder 26 is slowly bled through the delay means or bleed valve 27. As the pressure within the cylinder 26 is dissipated, its piston 25 is forced into retraction as the coil spring 28 pulls the bar 29 and the lower end of the heat applicator plate 22 toward the side of the apparatus 12.

The heat applicator plate 22 is thereby moved into the position shown in FIG. 6 of the drawings, in which its edge 31 applies heat from the heating rod 30 and some pressure simultaneously against the sealing flap 11*a* of the adjacent package 11. The sealing flap 11*a* and/or the side of the package 11 against which it seals are coated with suitable heat and pressure actuated adhesive material.

When the uppermost package 11 moves down the slide 35, the arm 32 is spring urged to move automatically downwardly, returning the microswitch 33 to its normal position. This reverses the operation of the spool valve 45, thereby causing operation of the cylinder 36 in the opposite direction. This moves its piston 37 and attached sweep rod 38 back toward normal position. When they reach their normal position, the corner member 39 engages the arm 41 to close the microswitch 42.

Closing of the microswitch 42 closes the valve 60 to perform two functions simultaneously. First, it closes the line supplying pneumatic pressure to the cylinder 26, thereby causing its piston 27 to move the heat applicator plate 22 away from the package 11 with which it was in contact. Second, it closes the pressure supply line to the valve 15*a* to reverse the operation of the spool valve 40 and operate the cylinder 16 to retract the platform 18. The vertical side of the platform 18 holds the next package 11 against moving completely into the apparatus 12 and thereby prevents the new package 11 from engaging the arm 14 of the microswitch 15 until the previous cycle is fully completed.

Mounted on opposite sides of the apparatus 12 are a pair of vertically directed side pressure plates 50, which are constantly urged inwardly into engagement with the sides of the top four packages 11 by coil springs 51 mounted on bolts 52.

The pressure plates 50 act to exert constant pressure on the initially sealed flaps 11*a* of the package 11 during substantially all of the time the packages are in the apparatus 12.

It will be noted that the flap 11 of each package 11 is initially sealed by the operation of heat and pressure through the edge 31 of the heat applicator plate 22. Each package is then moved upwardly between the opposite side plates 50, where it is subjected to constant lateral pressure on its sealing flap 11*a* while four additional packages are moved in beneath it. The pressure time is accordingly approximately four times as long as the operating cycle of the apparatus for a single package.

I claim:

1. An apparatus for sealing the flaps of food packages, said apparatus comprising:

means for receiving a plurality of successive packages for sealing;

platform means operable for successively moving packages entering said apparatus vertically upwardly within said apparatus to form a vertical stack;

holding means for engaging the bottom package of said stack to support said stack in spaced relation above said platform means;

a heat applicator plate mounted on one side of said apparatus and including a heated portion;

means for moving said heated portion of said heat applicator plate into and out of engagement with the flap of each said package when said package constitutes the bottom package of said stack;

pressure plate means disposed at a side of said apparatus and including a vertically extending plate having a height substantially greater than the vertical height of one of said packages;

means resiliently urging said plate inwardly toward said stack for applying lateral pressure against said flaps of said packages continuously subsequent to engagement of said flaps by said heated portion of said heat applicator plate, and during substantially the entire time said packages form a part of said stack;

sweep means operative for engaging and laterally moving the uppermost package of said stack upon upward movement of a package to the bottom of said stack by said platform means;

conveyor means for carrying away said uppermost package upon lateral movement thereof by said sweep means;

first switch means engageable by an entering package moving into said apparatus to initiate upward movement of said platform means and said entering package to locate said entering package at the bottom of said stack;

second switch means engageable by the uppermost package of said stack upon upward movement of said stack to initiate operation of said sweep means; and third switch means engageable and disengageable by said sweep means to operate said means for moving said heated portion of said heat applicator plate.

2. An apparatus according to claim 1 wherein said third switch means is disengageable from said sweep means to render said platform means inoperative to move said packages upwardly, and engageable by said sweep means to render said platform means operative to move said packages upwardly.

3. An apparatus according to claim 1 wherein said means for moving said heated portion includes delay means for delaying movement of said means for moving said heated portion away from said bottom package a predetermined time interval subsequent engagement of said third switch means by said sweep means.

4. An apparatus for sealing the flaps of food packages, said apparatus comprising:

means for receiving a plurality of successive packages for sealing;

platform means for successively moving packages entering said apparatus vertically upwardly within said apparatus to form a vertical stack;

holding means for engaging the bottom package of said stack to support said stack in spaced relation above said platform means;

a heat applicator plate mounted on one side of said apparatus and including a heated portion;

means for moving said heated portion of said heat applicator plate into and out of engagement with the flap of each said package when said package constitutes the bottom package of said stack;

pressure plate means disposed at a side of said apparatus and including a vertically extending plate having a height substantially greater than the vertical height of one of said packages;

means resiliently urging said plate inwardly toward said stack for applying lateral pressure against said flaps of said packages continuously subsequent to engagement of said flaps by said heated portion of said heat applicator plate, and during substantially the entire time said packages form a part of said stack;

first switch means engageable by an entering package moving into said apparatus to initiate upward movement of said platform means and said entering package to locate said entering package at the bottom of said stack; and means responsive to location of each said package at the bottom of said stack to operate said means for moving said heated portion of said heat applicator plate.

5. An apparatus according to claim 4 wherein said means for moving said heated portion includes delay means for delaying movement of said means for moving said heated portion a predetermined time interval subsequent location of said package at the bottom of said stack.

* * * * *